United States Patent [19]

Eisnor et al.

[11] 3,959,757

[45] May 25, 1976

[54] CIRCUIT BREAKER WITH MAGNETIC ASSIST

[75] Inventors: David L. Eisnor, Norton, Mass.; Roland G. Morin, Central Falls, R.I.

[73] Assignee: Texas Instruments Incorporated, Dallas, Tex.

[22] Filed: June 21, 1974

[21] Appl. No.: 481,593

[52] U.S. Cl. ..... 335/147; 335/192; 335/195

[51] Int. Cl.[2] ..... H01H 53/00

[58] Field of Search ..... 335/15, 16, 38, 147, 335/170, 46, 192, 193, 195; 337/74

[56] References Cited

UNITED STATES PATENTS

| | | | |
|---|---|---|---|
| 3,238,326 | 3/1966 | Frey | 335/195 |
| 3,263,042 | 7/1966 | Dyer et al. | 335/16 X |
| 3,419,828 | 12/1968 | Brewer | 335/195 X |
| 3,697,915 | 10/1972 | Brassard | 337/74 |
| R18,630 | 10/1932 | Van Sickle | 335/195 |

FOREIGN PATENTS OR APPLICATIONS

| | | | |
|---|---|---|---|
| 124,494 | 1959 | U.S.S.R. | 335/195 |

*Primary Examiner*—George Harris
*Attorney, Agent, or Firm*—John A. Haug; James P. McAndrews; Russell E. Baumann

[57] ABSTRACT

In order to eliminate contact bounce and electrodynamic repulsive forces upon closure in a standard high rating circuit breaker device when a fault exists, an armature is disposed on the movable contact assembly and an iron core pole is disposed adjacent the stationary contacts, the normal current path providing a partial turn about the core. As current passes through the contact assembly the resulting magnetic field attracts the armature and hence the movable contact assembly toward the stationary contacts.

10 Claims, 4 Drawing Figures

CIRCUIT BREAKER WITH MAGNETIC ASSIST

BACKGROUND AND SUMMARY OF INVENTION

This invention relates to a new and improved circuit breaker, and more particularly to a new and improved circuit breaker of the thermostatic type with a magnetic assist for applications in which it is desired to interrupt an electrical circuit under predetermined conditions. Circuit breakers of the type described in U.S. Pat. No. 3,697,915 have found wide acceptance in the marketplace and are very effective for many applications, however, they are limited in their ability to close on a very high current fault without failing by having the contacts weld shut or by having excessive arc erosion.

It is an object of the invention to provide a new and improved circuit breaker particularly suitable for closing on high current faults by eliminating contact bounce or electrodynamic separation, to provide additional contact force without adding to unlatch forces and to provide a circuit breaker where the amount of assist or additional contact force is automatically regulated by the demand or level of fault current. Another object of this invention is to provide a circuit breaker in which interrupting capacity is not significantly sensitive to closure velocity and to provide an assist system that does not effect trip time and therefore maintains inherent coordination capability. Yet another object of the invention is to provide a circuit breaker which is economical to manufacture and is readily adapted to mass production and to provide such a circuit breaker which is of small size, light weight and exceedingly compact structure. Other objects will be in part pointed out hereafter.

Known prior art miniature circuit breakers are limited in their ability to close on high current faults. In such breakers as the movable contacts close on a high current fault during a reset operation, the movable contacts pass through a point of zero contact force at which point the high current fault causes the contacts to bounce apart with severe arcing resulting. Such arcing results in melting of metal on the contact surface. As the reset operation is finished and the contact force is biased toward closure, the contacts are again brought together, but this time they may weld together when the melted material on the contact surface solidifies. Of course, this welding action could prevent the trip mechanism from separating the contacts and a failure could occur.

The present invention uses a magnetic assist employing an iron core pole piece and an armature to prevent contact bouncing. An iron core is positioned between two stationary contacts of a conventional circuit breaker and is insulated with dielectric material so that the current path of the circuit breaker forms a partial loop about the core. An armature of a magnetic material is affixed to the back plate of the movable contacts. Then, when closing on a current fault, the current flowing around the core will cause a magnetic field which in turn will exert an instant force on the armature in the closing direction of the movable contacts and will prevent them from bouncing or magnetostrictively being forced back. The amount of force exerted by the magnetic field is proportional to the amount of current flowing through the circuit breaker and therefore can be easily calibrated to work in coordination with the thermostatic type circuit breaker so as to only be effective when large amounts of current pass through the circuit breaker.

The invention accordingly comprises the elements and combinations of elements, features of construction and arrangements of parts which will be exemplified in the structures hereinafter described and the scope of the application of which will be indicated in the appended claims.

In the accompanying drawings in which one of the various possible embodiments of the invention is illustrated:

Figure 1:
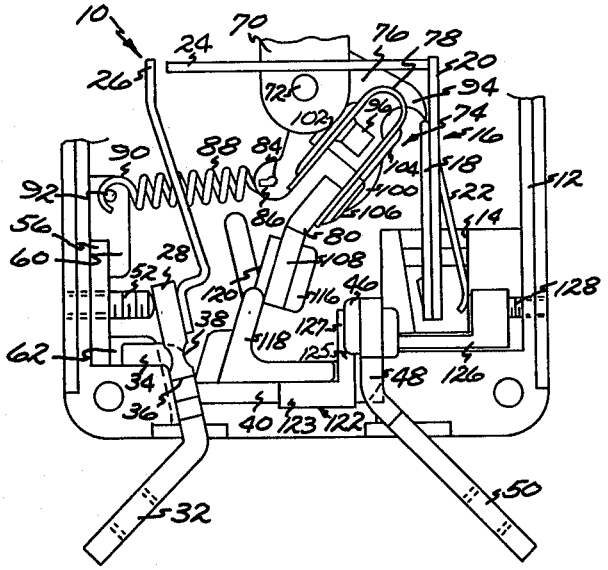
FIG. 1 is a partial elevation of a circuit breaker made in accordance with the invention with the front half of the casing removed and with the contacts in the disengaged or open circuit position.

The dimensions of certain of the parts as shown in the drawings may have been modified or exaggerated for the purpose of clarity of illustration.

Referring now to the drawings, and more particularly to FIGS. 1 to 4, one embodiment of this invention takes the form of a thermostatic single phase circuit breaker (although equally applicable to multiphase circuit breakers) generally indicated by reference numeral 10 and includes a housing which may be formed of two shells or halves to facilitate assembly thereof. A back casing half 12 cooperates with a similar front casing half which has been removed for the purpose of illustration, and may be made of any suitable strong, insulating and arc-resistant material or the like. A compartment 14 is defined in the casing and receives therein ambient compensation assembly 16 which includes an elongated catch member 18 attached at its lower end to a compensating bimetallic member 20 and a catch return spring 22. A motion transfer plate 24 is slidably mounted in the casing and is adapted to transfer motion from a current responsive bimetallic trip arm 26 to the ambient compensation assembly 16.

Figure 3:
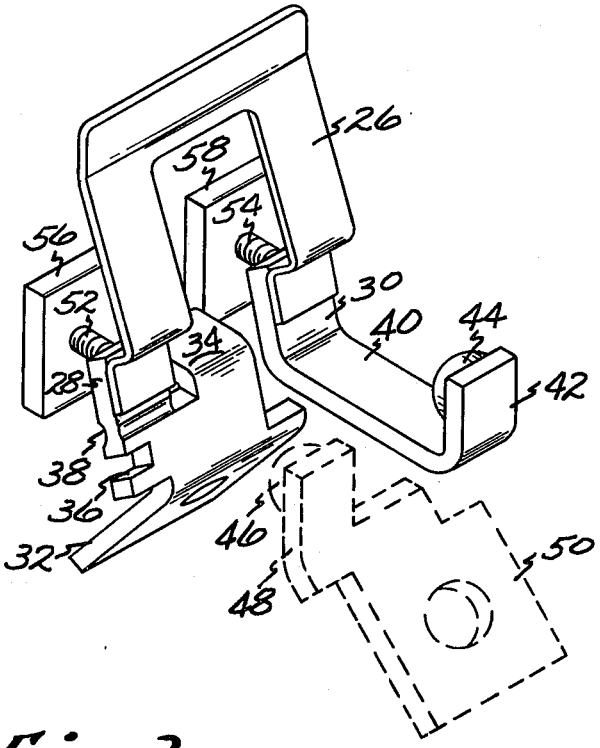
FIG. 3 is a perspective view of the current responsive means and dual calibrating screws depicted in FIGS. 1 and 2.

As best seen in FIG. 3, trip arm 26 is generally U-shaped having distal leg portions which are brazed to tab portions 28 and 30 of terminal 32 and stationary contact arm 40 respectively. Terminal 32 also is provided with platform 34 and slot 36 which cooperate with the casing for firmly locking the terminal in its intended location. A notch is provided in terminal 32 just below tab portion 28 to facilitate calibration in a manner to be explained below. Stationary contact arm 40, opposite tab portion 30, is provided with another upstanding portion 42 on its distal end which mounts stationary contact 44. Another stationary contact 46 is mounted on portion 48 of terminal 50.

Calibration screws 52, 54 are inserted in apertures provided in the side wall of the casing and are threaded in plates 56, 58 respectively. Plates 56, 58 are slidably inserted between bosses 60 and 62 formed in the casing.

Figure 2:
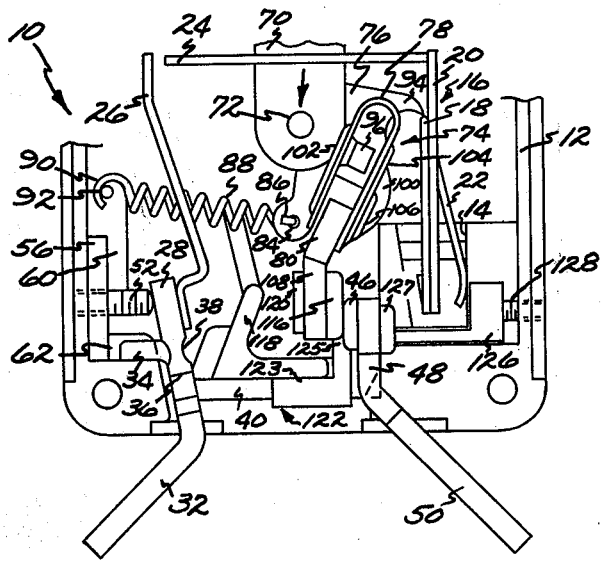
FIG. 2 is a partial elevation of a circuit breaker similar to FIG. 1, but with the contacts in the engaged or closed circuit position.
Figure 4:
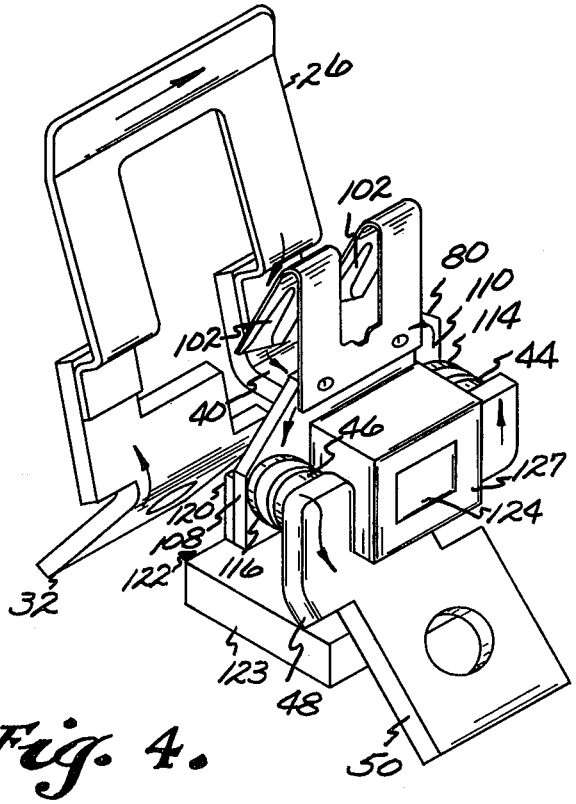
FIG. 4 is a perspective view of portions of the circuit breaker showing of the current path around the iron core pole in the circuit breaker.

Latch plunger 70 is one part of the manual actuating means and is movable between a first open circuit switch position and a second closed circuit position as indicated in FIGS. 1 and 2 respectively. Since any suitable manual actuating means can be employed with the instant invention and since it does not relate to the invention per se, details of the manual actuating means have not been shown. Latch plunger 70 mounts pin 72 which in turn pivotally mounts movable contact assembly 74, the main elements of which comprise bell crank 76, movable contact spring 78 and contact bar 80. Bell crank latch 76 is provided with a bore which receives pin 72 in plunger 70 and is movable therewith. Another bore 84 is provided in bell crank latch 76 to permit attachment of one end 86 of spring 88. The other end 90 of spring 88 is attached to pin 92 mounted in the wall of casing 12. It will be noted that spring 88 places a clockwise torque on bell crank 76 as viewed in FIGS. 1 and 2 tending to rotate bell crank 76 about pin 72. Bell crank 76 is also provided with tongue or latch 94 which contacts catch 18 in such a way that further clockwise rotation of bell crank 76 is precluded as long as the catch 18 remains in the position shown. Contact spring 78 is secured to bell crank 76 by means of angle brackets 96 on opposite faces of the bell crank. A cutout portion is provided in contact spring 78 to permit insertion of bell crank 76. Contact spring 78 is bent back on itself in a U-shaped configuration and is retained by lip 100 on bell crank 76. Thus, as plunger 70 is forced downwardly when latch 94 contacts catch 18, a counterclockwise torque is placed on the contact assembly 74. In the FIG. 2 contacts closed position, lip 100 separates from the contact spring 78 so that spring 78 will provide an effective contact force. In order to stiffen contact spring 78, ribs 102, 104 are located on the leg portions. Use of brackets 96 and ribs 102, 104 provide increased contact force which is required due to the increased instantaneous let-through currents to which the circuit breaker is subjected under short circuit fault conditions. That is, the electrodynamic repulsion forces at the contact faces increase in a higher current rating device due to the higher let-through currents. Insulating mat 106 is mounted on that portion of contact spring 78 which is contiguous to the contact area to preclude damage to the spring in the event of arcing. A mechanical connection is effected between contact spring 78 and contact bar 80 as by upsetting several projections from the contact bar which are received in mating apertures in the spring plate and headed over. Contacts 114, 116 are brazed to tab portion 110, 108 respectively of contact bar 80 with an armature 120 mounted on the back of the contact bar as by brazing thereto. The armature 120 may be conveniently formed of a conventional rectangular magnetic piece of material such as iron so it will respond to the presence of a magnetic field. Stop wall 118 is provided in casing 12 to limit the motion of contact bar 80 in the open contacts direction. As shown in FIGS. 1, 2 and 4 inserted in a central groove in the lower part of casing 12 is a piece of dielectric material 122. The dielectric piece 122 has a base portion 123 which fits into the central groove within the casing 12, a neck portion 125 which connects the base 123 to the top portion 127 and a hollow top portion 127 which is made to accept the pole piece 124 therein.

The pole piece 124 within the dielectric material 122 is centered between the two stationary contacts 44 and 46 respectively. The precise positioning of the pole piece is controlled by a calibration screw 128 inserted in the side wall of the casing 12 which moves a linkage piece 126 which butts up against the top portion 127 of the dielectric material which is free to move along the central groove in the lower part of the casing 12 and thereby accurately position the pole piece 124. Due to the design and initial placement of the dielectric material piece 122, the calibration system need only move in one direction, but a perfectly acceptable alternate system would be one which employed a biasing spring which would bias the dielectric piece toward the initial placement.

Electric current passes through the circuit breaker from terminal 32 through trip arm 26, stationary contact arm 40, up to contact 44, movable contact 114, through contact bar 80 effectively passing over pole 124, movable contact 116, contact 46 and down to terminal 50. Thus it will be seen that this current path makes a partial loop around the iron core pole piece and thereby provides a magnetic field. In response to this magnetic field, armature 120 attached to contact bar 80 exerts a force in the direction of contact closure to essentially eliminate contact bounce. The strength of the magnetic field and in turn the contact closure force will depend upon the particular amperage and frequency of the current so the size and shape of the iron core pole piece is chosen to match a particular current amperage and frequency to produce the desired effect. Proper positioning of the iron core pole piece must also be attained so a linkage piece and calibration screw are conveniently employed to assure the correct location.

It should also be understood that the magnetic assist of this present invention can be employed with circuit breakers other than the one shown and described in the proposed embodiment. However, for further information on the details and features of the particular circuit breaker described reference may be made to U.S. Pat. No. 3,679,915 referred to previously.

It should be understood that although the particular embodiment of the circuit breaker has been described by way of illustration, this invention includes all modifications and equivalents thereof falling within the scope of the appended claims.

We claim:

1. A circuit breaker comprising:

a casing;

stationary contact means mounted in the casing;

movable contact means movably mounted in the casing and movable into and out of engagement with the stationary contact means;

overcurrent means mounted in the casing adapted to cause the movable contact means to move out of engagement with the stationary contact means upon the occurrence of a predetermined overcurrent;

a contact engagement assist means to increase the contact force between the movable and stationary contact means upon engagement of the movable with the stationary contact means; and

2. A circuit breaker according to claim 1 in which the contact engagement assist means includes an armature mounted on the movable contact assembly and a magnetic pole disposed adjacent the stationary contact means.

3. A circuit breaker according to claim 2 wherein the magnetic pole piece disposed adjacent the stationary contact means is movable by said calibration means for varying the position of the pole piece.

4. A circuit breaker according to claim 3 wherein said calibration means for varying the position of the pole piece comprises a calibration screw and linkage piece.

5. A circuit breaker according to claim 2 in which the movable contact assembly includes a bar which extends over the top of the pole piece and terminal means extend along at least one side of the pole piece whereby a partial current loop is formed around the pole piece.

6. A circuit breaker according to claim 3 in which the partial current loop found around the pole piece is a ¾ turn.

7. A circuit breaker according to claim 6 further including a piece of dielectric material, the dielectric material formed with an opening therein, the pole piece is an iron core located in the opening of the piece of dielectric material and the armature is a iron piece mounted on the movable contact assembly.

8. A circuit breaker comprising:

a casing;

stationary contact means mounted in the casing;

movable contact means movably mounted in the casing and movable into and out of engagement with the stationary contact means;

overcurrent means mounted in the casing including a catch movable from a latch retaining position to a latch releasing position upon occurrence of overcurrent conditions;

the movable contact means including a latch engageable with the catch;

manual actuating means operatively connected to the movable contact means to move the movable contact means into engagement with the stationary contact means upon actuation of the actuating means;

ambient compensation means mounted in the casing offsetting movement in the overcurrent means due to changes in ambient temperature;

the overcurrent means including a substantially U-shaped thermostatic member having two distal leg portions connected by a bight portion, the bight portion operatively connected to the catch, the bight portin movable to cause movement of catch, terminal means including two upstanding mounting tabs separately supported in the casing, each tab having first and second surfaces on opposite sides thereof, the two distal leg portions attached to respective tab portions on said first surfaces and camming means mounted in the casing to cam the said second surfaces to adjust the effective position of the thermostatic member to thereby calibrate the circuit breaker;

a contact engagement assist means to increase the contact force between the movable and stationary contact means upon engagement of the movable with the stationary contact means; and calibration means for providing coordination between said overcurrent means and said contact engagement assist means.

9. A circuit breaker according to claim 8 in which a pole piece is positioned adjacent to the stationary contact means so the current path of the circuit breaker makes a ¾ loop around the pole piece and the armature is mounted to a contact assembly of the movable contact means.

10. A circuit breaker according to claim 9 further including a piece of dielectric material, the dielectric material formed with an opening therein, the pole piece is an iron core located in the opening of the piece of dielectric material and the armature is a iron piece mounted on the movable contact assembly.

* * * * *

UNITED STATES PATENT OFFICE

CERTIFICATE OF CORRECTION

PATENT NO. : 3,959,757

DATED : May 25, 1976

INVENTOR(S) : David L. Eisnor and Roland G. Morin

It is certified that error appears in the above-identified patent and that said Letters Patent are hereby corrected as shown below:

Claim 1, column 4, lines 41 to 55 should read:

1. A circuit breaker comprising:

a casing;

stationary contact means mounted in the casing;

movable contact means movably mounted in the casing and movable into and out of engagement with the stationary contact means;

overcurrent means mounted in the casing adapted to cause the movable contact means to move out of engagement with the stationary contact means upon the occurrence of a predetermined overcurrent;

a contact engagement assist means to increase the contact force between the movable and stationary contact means upon engagement of the movable with the stationary contact means; and calibration means for providing coordination between overcurrent means and contact engagement assist means.

Signed and Sealed this

Seventeenth Day of August 1976

[SEAL]

*Attest:*

RUTH C. MASON
*Attesting Officer*

C. MARSHALL DANN
*Commissioner of Patents and Trademarks*